US006009604A

United States Patent [19]

Fildan

[11] Patent Number: 6,009,604

[45] Date of Patent: Jan. 4, 2000

[54] FRONT CLOSURE FOR A BRASSIERE

[76] Inventor: Gerhard Fildan, Wohnpark Alte Eriaa, Anton Baumgartner Str. 44, C 4 17 01, A-1232 Vienna, Austria

[21] Appl. No.: 09/189,363

[22] Filed: Nov. 9, 1998

[51] Int. Cl.[7] ..... A41F 1/00; A44B 11/00

[52] U.S. Cl. ..... 24/662; 24/318; 24/324

[58] Field of Search ..... 24/662, 663, 324, 24/116 A, 625, 318; 2/73

[56] References Cited

U.S. PATENT DOCUMENTS

| | | | |
|---|---|---|---|
| 1,947,394 | 2/1934 | Heinze | 24/318 |
| 2,030,471 | 2/1936 | Sabins | 24/662 |
| 2,274,482 | 2/1942 | Jones | 24/318 |
| 5,380,238 | 1/1995 | Crew-Gee | 2/73 |

FOREIGN PATENT DOCUMENTS

| | | | |
|---|---|---|---|
| 2632809 | 1/1978 | Germany | 24/662 |

*Primary Examiner*—Victor N. Sakran
*Attorney, Agent, or Firm*—Herbert Dubno

[57] ABSTRACT

A front closure for a brassiere has male and female parts which have frame portions through which fabric parts of the respective cups can pass for attaching these cup portions to the closure members. The male member has a bar received in a trough or channel of the female member and is locked in place releasably by a partial rotation of the male member about the axis of the bar. The bar can be inserted at least in part transversely to the channel or trough when the plane of the male member is transverse to the plane of the female member.

22 Claims, 9 Drawing Sheets

FRONT CLOSURE FOR A BRASSIERE

FIELD OF THE INVENTION

My present invention relates to a front closure for a brassiere and to a brassiere provided with the improved front closure. More particularly the invention relates to a brassiere having a pair of fabric cups and a closure interconnecting the cups at the front of the brassiere.

BACKGROUND OF THE INVENTION

While brassieres are available in a large number of configurations and designs, most of them permanently interconnect cups of the brassiere at the front thereof and provide a rear closure of the hook-and-eye or other type of connecting rear straps of the garment. The brassiere can be provided with shoulder straps which are adjustable and, in the case of maternity brassieres, can have special fittings enabling one or the other cup to be lowered to expose the breast for nursing purposes. For many women manipulation of a back closure is difficult and hence, for arthritics, the convenience of a front closure is significant.

In an earlier front closure for a brassiere, a male member was fitted into a female member by longitudinally sliding a bar of the male member practically over its entire length into a channel provided in the female member. The result of this sliding action enabled the two members to be locked relative to one another by swinging the two members about an axis of the bar into a locked position in which the two members could not be separated.

For ease of manipulation, particularly by women with arthritic conditions, and for some brassiere designs in which the fabric pieces at the front of the brassiere are relatively wide, the closure must be comparatively long and any interfitting of the male and female members with the need to displace the male member into the channel over practically the full height or length of the closure, made connection of the two closure parts difficult. Indeed, closures of that type could not readily be transformed into long or high closures without running the risk that manipulation would be difficult.

OBJECTS OF THE INVENTION

It is, therefore, the principal object of the invention to provide a relatively tall or long separable closure, particularly for use as the front closure of a brassiere, whereby these drawbacks can be avoided.

Another object of this invention is to provide a front closure for a brassiere which can be readily manipulated by an individual with manipulation difficulty, especially an arthritic condition, but yet which will be aesthetic in appearance and secure and reliable in use.

Still another object of this invention is to provide a front closure in which the male member can readily be fitted into and secured in the female member but wherein the stroke with which the male member must be moved relative to the female member is reduced by comparison with earlier systems.

Still another object of this invention is to provide an improved closure for the purposes described which can be fabricated relatively simply.

SUMMARY OF THE INVENTION

These objects and others which will become apparent hereinafter are attained, in accordance with the invention in a front closure for a brassiere which is less likely to unintentionally open by comparison with earlier closures and wherein male and female members are interconnected so that a bar of the male member can be inserted into the female member and rotated therein so as to lock the member in place. Important to this invention is a detent located substantially midway along the length of the bar and which resiliently secures the male member in its outwardly swung position, i.e. a position in which the two members are substantially coplanar.

I can provide a two-color system in which the frame members are of one color and can be used either as part of a female member of another color by bonding the male member to that female member, or as a movable male member removably inserted into that female member. Alternatively, the fixed frame portion may be part of the female member.

In another aspect of the invention, the male and female closure members may be interfitted by an axial movement of the bar of the male member into the channel or trough of the female member with a stroke or displacement with only a small fraction of the length of the bar or, in the case of anther embodiment, with no axial or longitudinal displacement at all. Longitudinal displacements which are practically the full length of the bar as were known from the prior art, can therefore be avoided.

More specifically, a closure for a garment can comprise a one-piece molded male closure member having an elongated first frame formed from a pair of parallel limbs connected by bights at opposite ends and surrounding an elongated slot whereby a first garment part is adapted to be looped around one of the limbs through the slot, a bar spaced from and parallel to the other of the limbs, and a pair of webs spaced inwardly from opposite ends of the bar and from one another connecting the bar with the other of the limbs, the first frame, the bar and the webs lying in a first plane;

a one-piece molded female closure member having an elongated second frame formed from a pair of parallel limbs connected by bights at opposite ends and surrounding an elongated slot whereby a second garment part is adapted to be looped around one of the limbs of the second frame and through the slot thereof, a trough formed on the other of the limbs of the second frame, lying in a second plane therewith and adapted to receive the bar in a position of the male member such that the first plane is substantially perpendicular to the second plane, the troughs having cutouts accommodating the webs upon; and detent means on at least one of the closure members between the webs and the cutouts for resiliently retaining the closure members in their coplanar positions.

A brassiere provided with that closure has each of the fabric cups connected to one of the aforementioned frames.

The bar can be round or polygonal, preferably the trough is open laterally over a major portion of the length of the bar and opens longitudinally into a sleeve of a length corresponding to a remaining portion of the length of the bar whereby the bar must be shifted longitudinally in the trough into the sleeve to permit the rotation of the male closure member relative to the female closure member about the axis of the bar to render the closure members coplanar.

With that system the sleeve can be formed with a hole opening longitudinally away from the trough, the hole being formed by a pin during the molding operation. In practice it has been found that prior art systems in which the bar was required to move through practically its entire length into the channel of the female member, required a significantly longer pin in relative terms, i.e. relative to the length of the bar or channel, so that such fabrication methods were not practical for long or high closures.

The female part, i.e. the trough or channel, can be closed at one or both of its ends.

According to a further feature of the invention, the female member can have a flange which covers webs of the male member and thus provides the closure with a more aesthetic appearance from the front.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
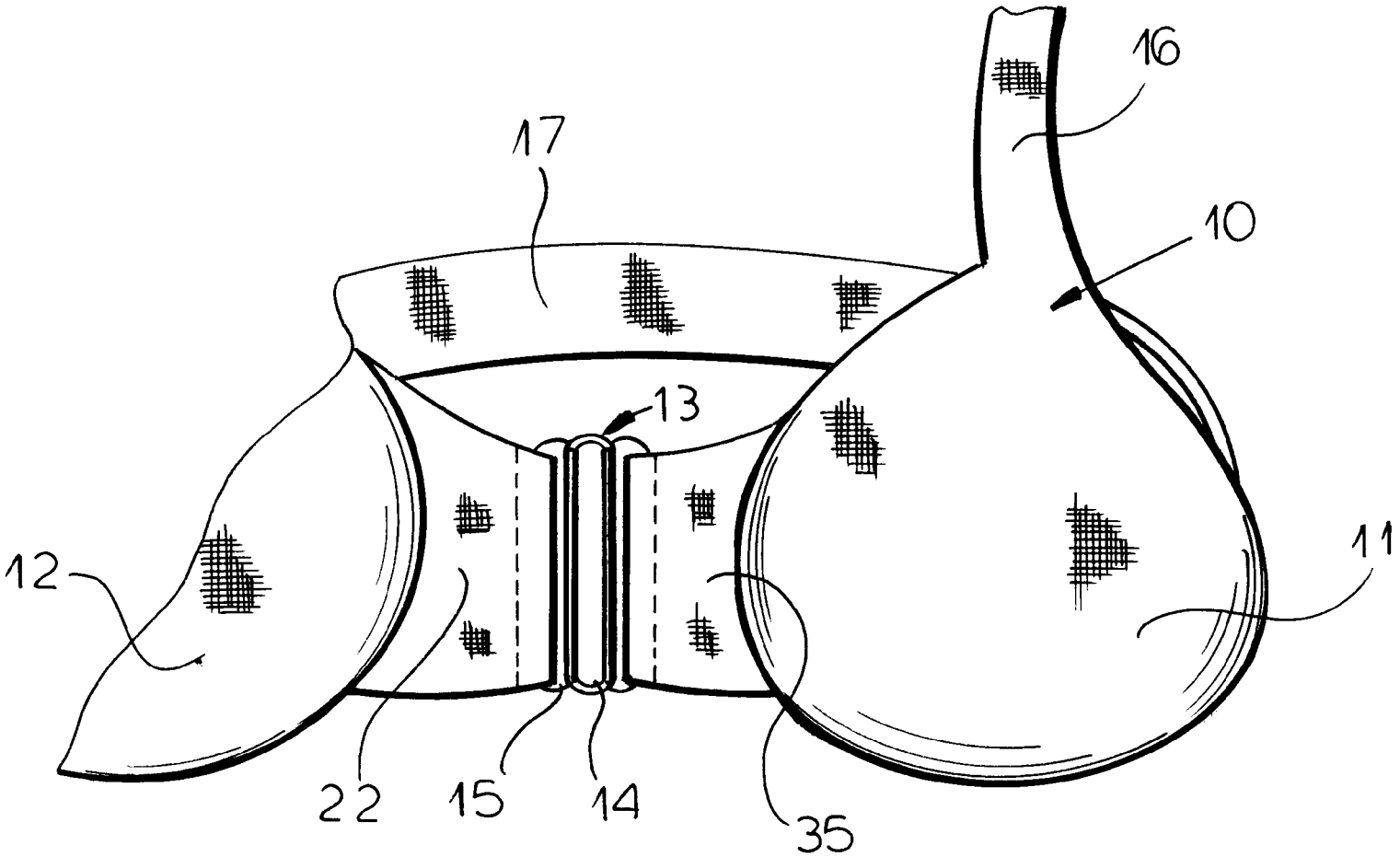
FIG. 1 is a fragmentary elevational view of a portion of a brassiere provided with a front closure according to the invention.
Figure 9:
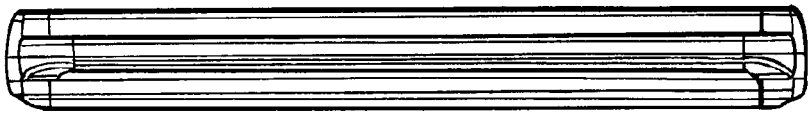
FIG. 9 is a side view of the female member.
Figure 5:
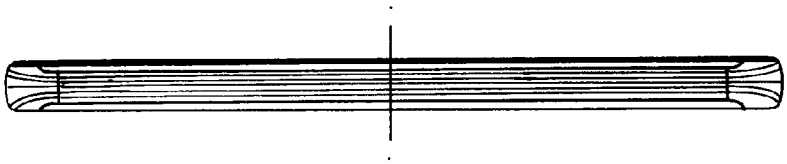
FIG. 5 is a side view of the male member.
Figure 2:
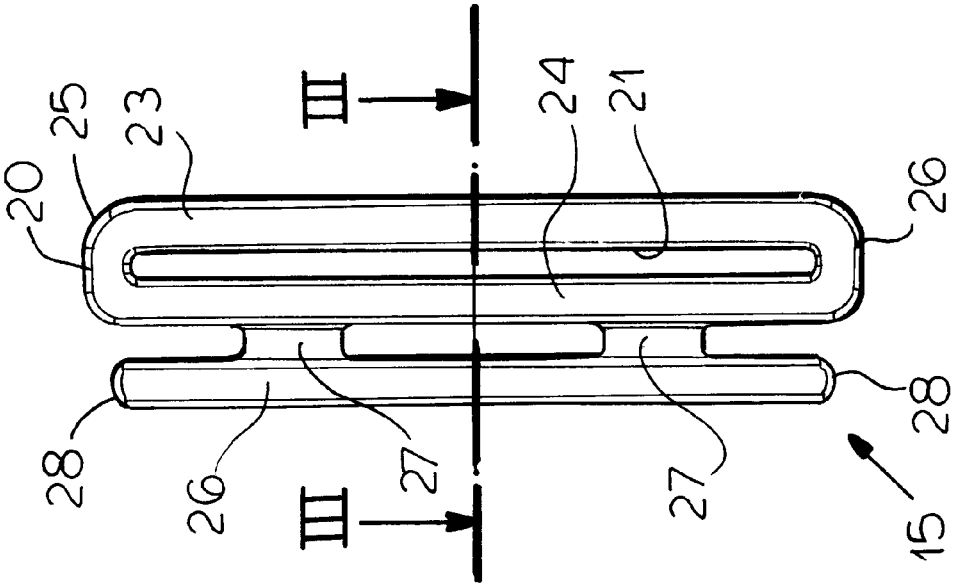
FIG. 2 is an elevational view of the male member of that closure.

Referring first to FIG. 1, which shows a front closure brassiere, it can be seen that the brassiere 10 comprises two cups 11 and 12 which are joined at the front by a front closure 13 comprising a female member 14 and a male member 15. The brassiere is shoulder straps, one of which is visible at 16, and a back strap 17. The male member 15 of the closure can comprise a frame 20 having a slot 21 through which the fabric strip 22 of one brassiere cup is passed, so that that fabric strip is looped on limb 23 of the frame 20.

Figure 4:
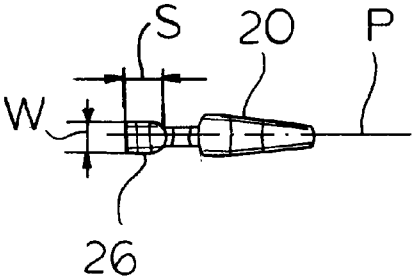
FIG. 4 is an end view of that male member.

The frame 20 also comprises a limb 24 connected to the limb 23 by a pair of bights 25 and 26. The frame 20 lies in a plane P (see FIG. 4).

Figure 3:
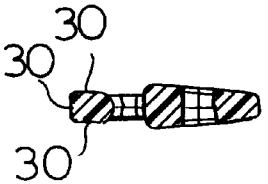
FIG. 3 is a cross sectional view taken along the line III—III of FIG. 2.
Figure 7:
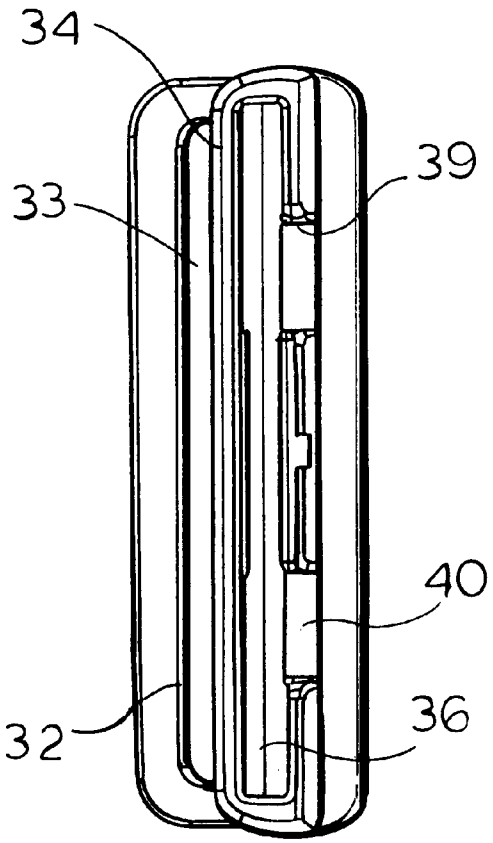
FIG. 7 is a rear view of the female member.
Figure 6:
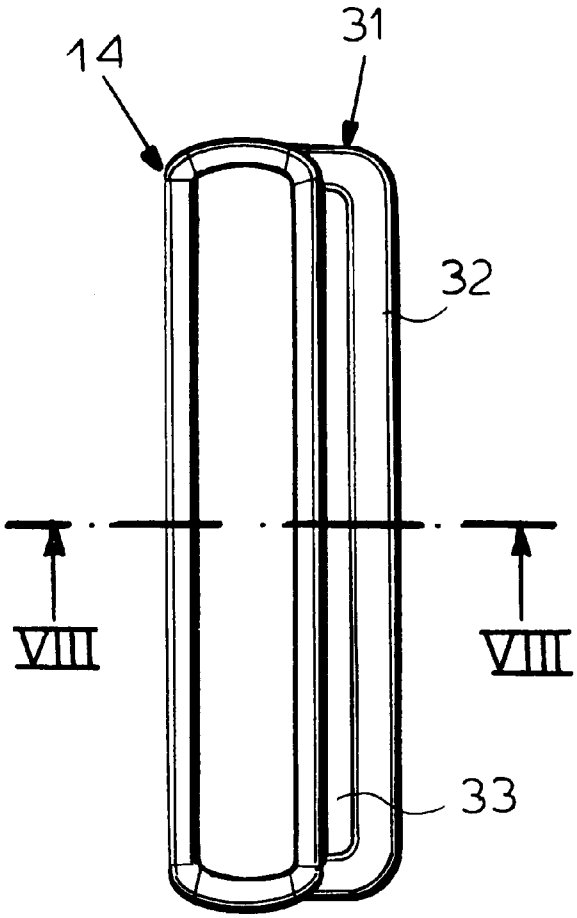
FIG. 6 is an elevational view of the female member.

In addition, the male closure member 15 comprises a bar 26 connected by webs 27 to the limb 24. The male closure member is injection molded in one piece. The ends of the bar 26 are rounded at 28 and the bar can have a polygonal cross section, i.e. can be provided with flat surfaces 30 as shown in FIG. 3.

The female member 14 of the closure can comprise a frame 31 having a limb 32 defining a slot 33 with a limb 34, another fabric portion 35 of the brassiere being looped around the limb 32 and passing through the slot 33 on the back of the female closure member 14, a trough 36 is formed between a rib 37 of the limb 34 and a rib 38, the rib 37 being cut away at 39 and 40 to accommodate the webs 27. To create a detent, the rib 37 is provided with an inwardly-extending projection 41 while the rib 34 is formed with the projection 42, overhanging the bar 26 when the latter is inserted into the trough 36. The width W of the bar 26 is equal to the width w between the formations 41 and 42 and is less than the dimension S of the bar in plane P. The female member lies generally in the plane P' shown in FIG. 8. In addition, the female member can have a flange 43 which can cover the webs 27 when the male member is inserted into the female member.

Figure 8:
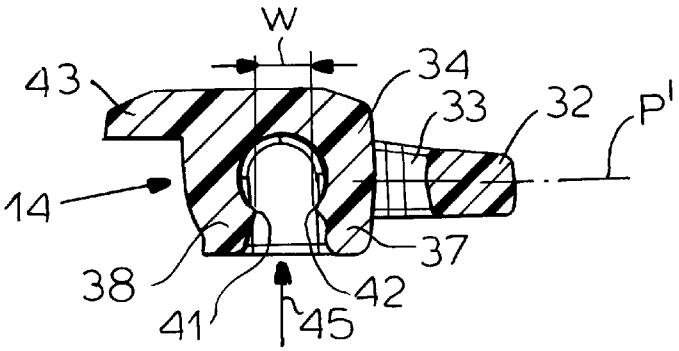
FIG. 8 is a cross sectional view taken along the line VIII—VIII of FIG. 6.

In operation, the bar 26 of the male member is inserted into the trough 36 in the direction of arrow 45, whereupon the male member is swung counterclockwise in the position shown in FIG. 8 to lock the bar 26 under the projections 41, 42. A longitudinal movement along the bar 26 is here not required.

Figure 12:
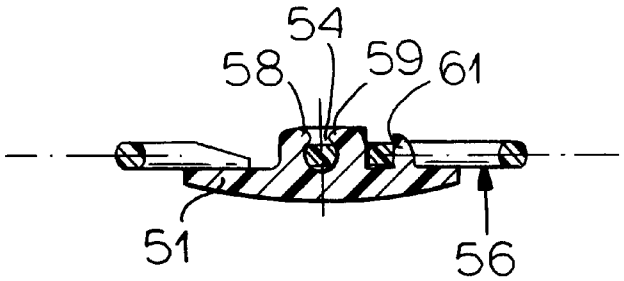
FIG. 12 is a cross sectional view taken along line XII—XII of FIG. 11.
Figure 11:
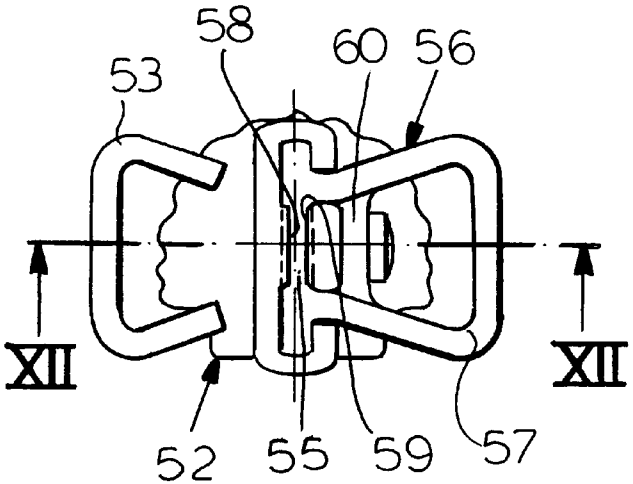
FIG. 11 is a rear view thereof.
Figure 10:
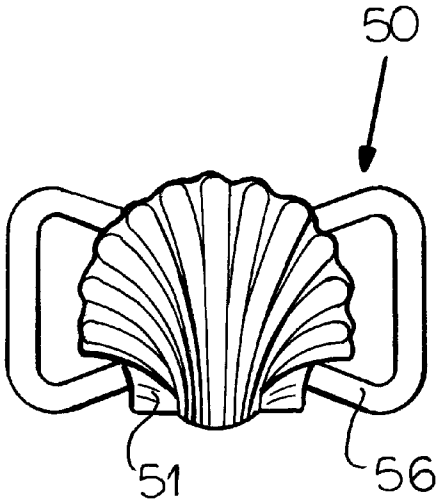
FIG. 10 is a front elevational view of another closure according to the invention.

In the embodiment of FIG. 10, the front closure 50 has a decorative shield 51 forming part of the female member 52. The latter can have a frame 53 and can be provided with a slot 54 accommodating the bar 55 of a male member 56 which is also of frame-like construction at 57. The width of the bar 55 is such that the latter can be easily inserted into slot 54 when the male member is turned transversely to the female member and then can be locked beneath the projections 58 and 59 adjoining the slot 54. In addition, the frame 57 can carry a transverse strut 60 which can lock into another slot 61 when the male and female members are swung into coplanarity in the position shown in FIG. 12. Since the frame 53 is formed unitarily with the decorative shield 51, it is of the same color as that of the shield. In this case it is advantageous aesthetically to make the male member 56 of the same color as well.

Figure 15:
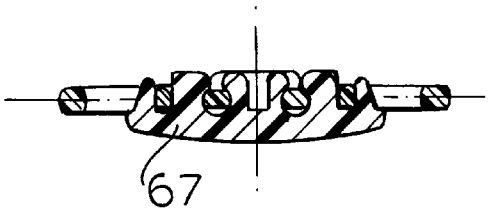
FIG. 15 is a cross sectional view taken along line XV—XV of FIG. 14.
Figure 14:
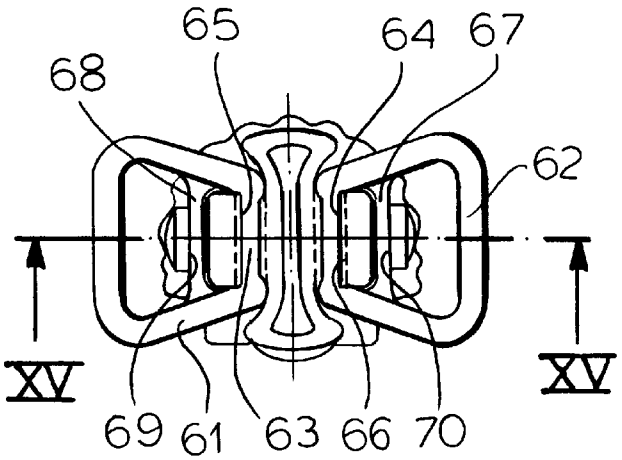
FIG. 14 is rear view of this embodiment.
Figure 13:
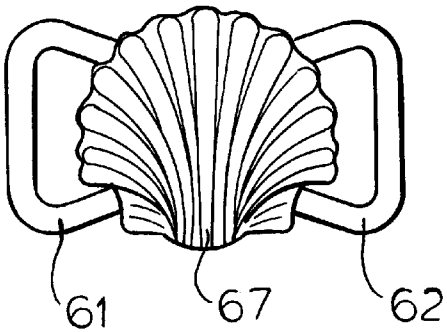
FIG. 13 is an elevational view of still another embodiment of a front closure according to the invention.

In the embodiment of FIGS. 13–15, the frame members 61 and 62 are identical and each bar 63, 64 is received in a respective slot 65, 66 overhanging the respective bar. The members 61 and 62 are frames whose struts 67 and 68 pass into additional slots 69 and 70 of the female member.

In practice, one of the frame parts 61 or 62 is inserted into the female member and then permanently affixed thereto by a drop of an adhesive or by thermal fusion. The other frame member 62 or 61 can then be removably inserted in the manner described to provide a detachable front closure. The fabric of the cups of the brassiere can be secured to the frame members 61 and 62 in the usual manner.

While the configurations in FIGS. 10 and 13 are the same, since the frame members 61 and 62 are fabricated separately from the female member 69, the shield 69 can be made of one color while the frame members 61, 62 are composed of another color.

Figure 18:
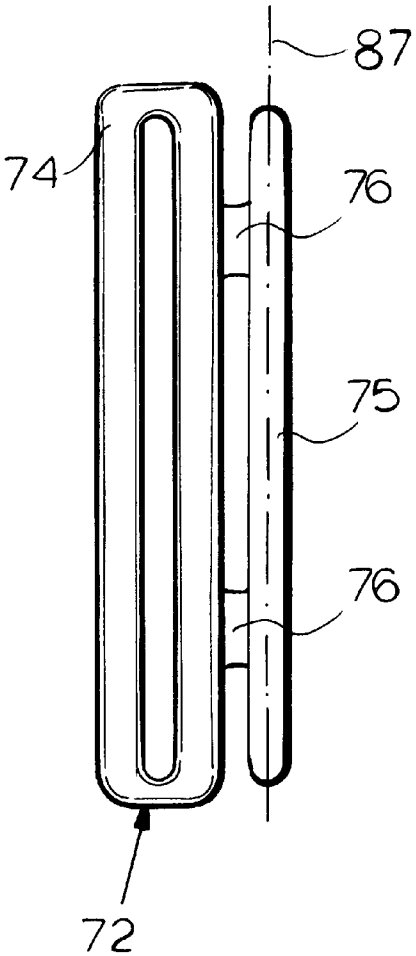
FIG. 18 is an elevational view of the male member separated from the female member.
Figure 17:
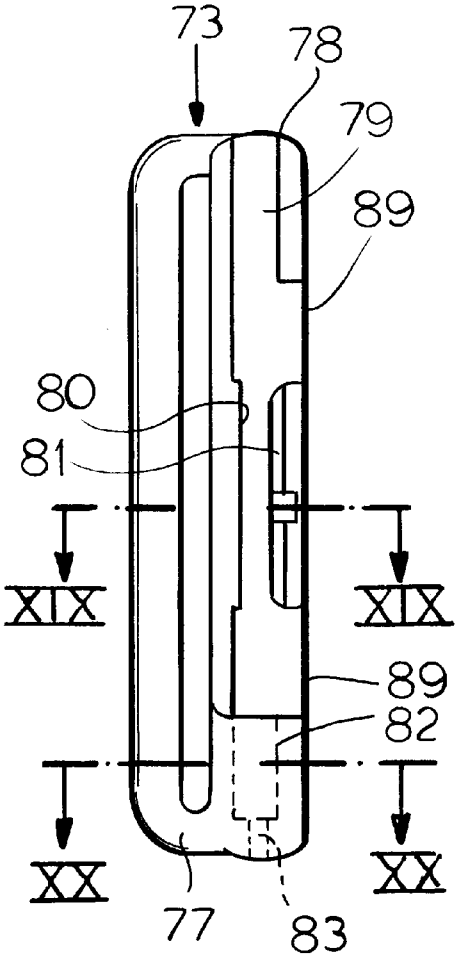
FIG. 17 is a rear view of the female member of that closure.
Figure 16:
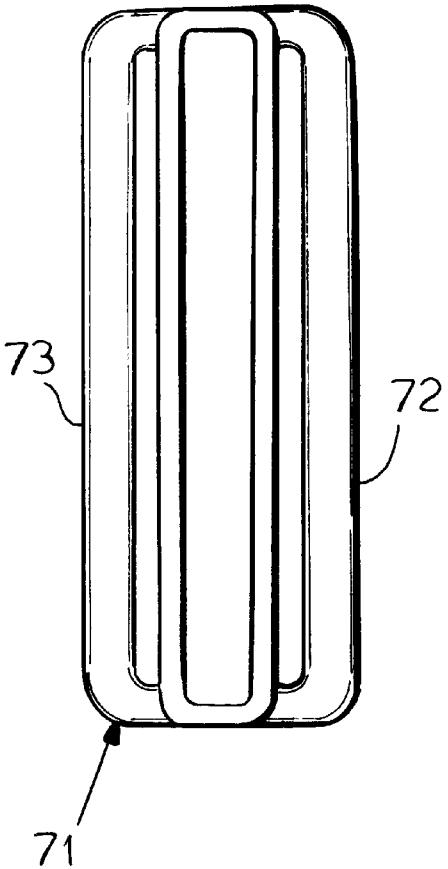
FIG. 16 is an elevational view of a brassiere front closure according to another embodiment of the invention.

The front closure 71 for the brassiere shown in FIG. 16 can comprise a male member 72 (FIG. 18) of the type that has already been described and a female member 73 which differs from that previously described as will be developed below (FIG. 17).

The male member 72 comprises the frame 74 connected with the bar 75 by the webs 76 while the female member 73 has a frame 77 which is formed on a frame limb 78 with a trough or channel 79 overhanging by the formations 80 and 81 forming a detent which locks the two members in their coplanar positions as has been described previously.

In this embodiment the channel 79 is open longitudinally at one end but is formed with a sleeve or closed portion 82 at the opposite end. The sleeve 82 is formed with a hole 83 through which a pin can extend during the molding process.

Figure 21:
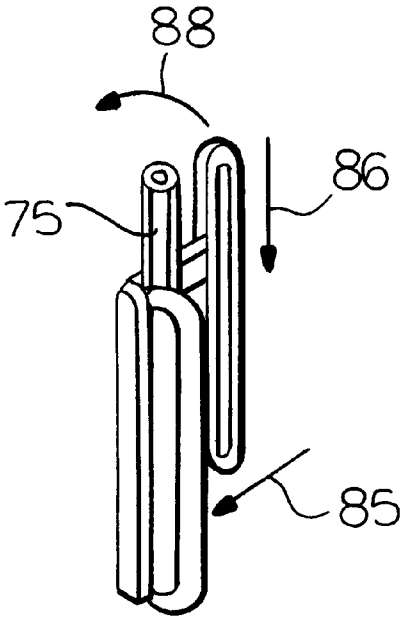
FIG. 21 is a perspective view drawn to a smaller scale showing the insertion of the male member into the female member for the closure of FIGS. 16–20.
Figure 20:
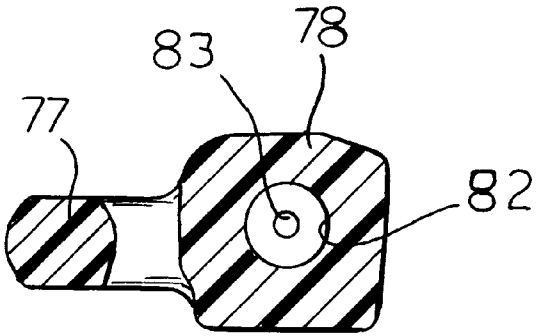
FIG. 20 is a cross sectional view taken along the line X—X of FIG. 17.
Figure 19:
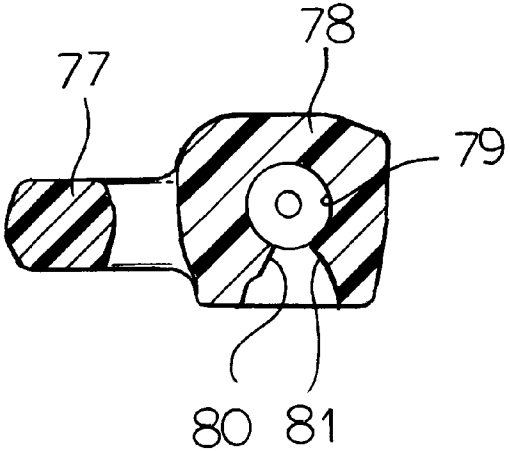
FIG. 19 is a cross sectional view through the female member taken along the line XIX—XIX of FIG. 17.

In practice, the bar 75 (FIG. 21) can be inserted into the channel in a direction transverse to the plane of the female member, i.e. in the direction of arrow 85 (FIG. 21) and then slid downwardly along with a channel (arrow 86) until the end of the pin 75 is engaged in the sleeve 82. Then the male member can be rotated about the axis 87 of the bar (in the counterclockwise sense represented by the arrow 88 in FIG. 21) to lock the bar in the channel 79. Because the sleeve 82 is of limited axial height and the webs 76 can come to lie in cut-outs 89 of the wall of the trough (see FIG. 17), the axial displacement 86 need not correspond to the full length of the bar 75. The result is a simple mode of interconnection of the male and female members and ease of locking and unlocking.

Figure 22:
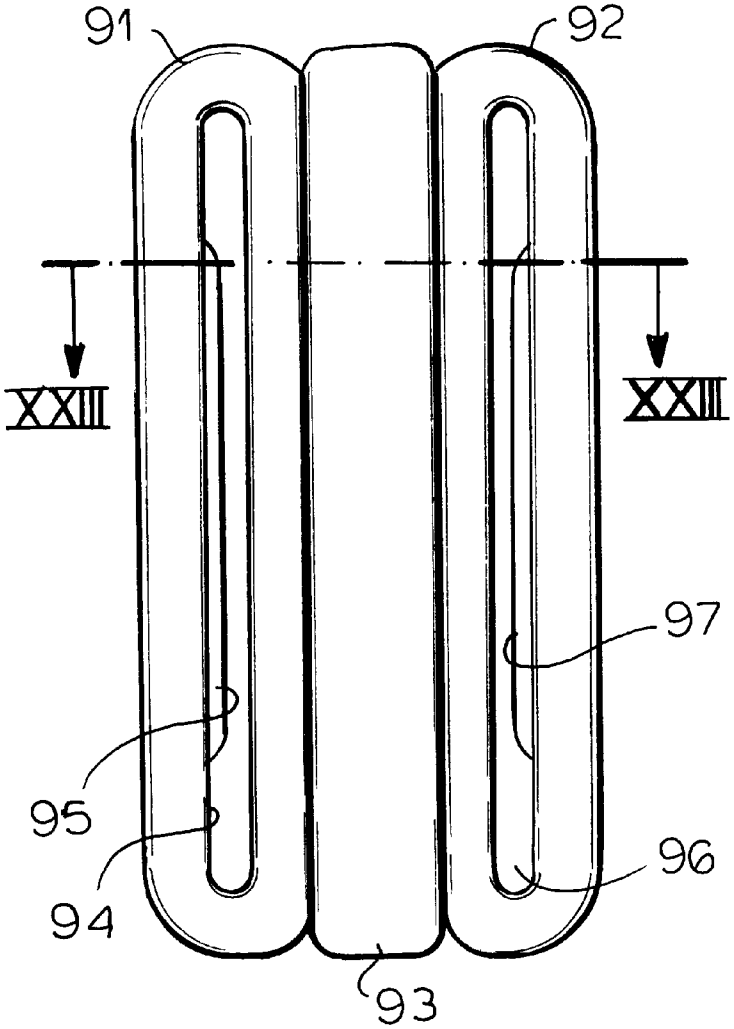
FIG. 22 is a view similar to FIG. 16 of another embodiment of the front closure according to the invention.
Figure 23:
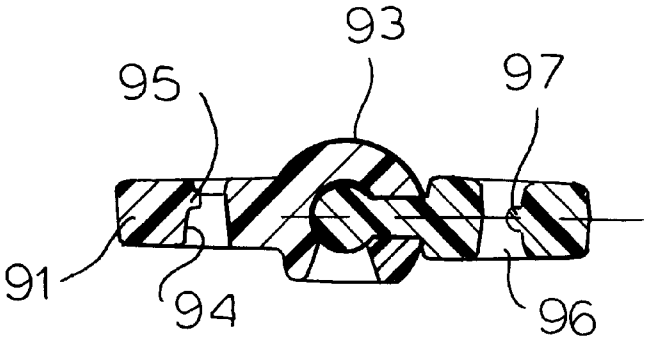
FIG. 23 is a section taken along the line XXIII—XXIII of FIG. 22.

From FIGS. 22 and 23, it will be apparent that the slots or eyes 94 and 96 of the male member and the female member 93 can be formed with bulges 95 and 97, respectively, which lie inwardly of the ends of the slots, and serve to prevent the fabric in the region of these bulges from pulling away from the central portion of the closure. Without these bulges, when the closure is under stress when the brassiere is worn, there is a tendency of the fabric attached to each of the closure members to pull away and leave a slot clearance in the slot which can be unaesthetic. With the bulges 95 and 97, the fabric remains close to the center portion of the closure.

Figure 25:
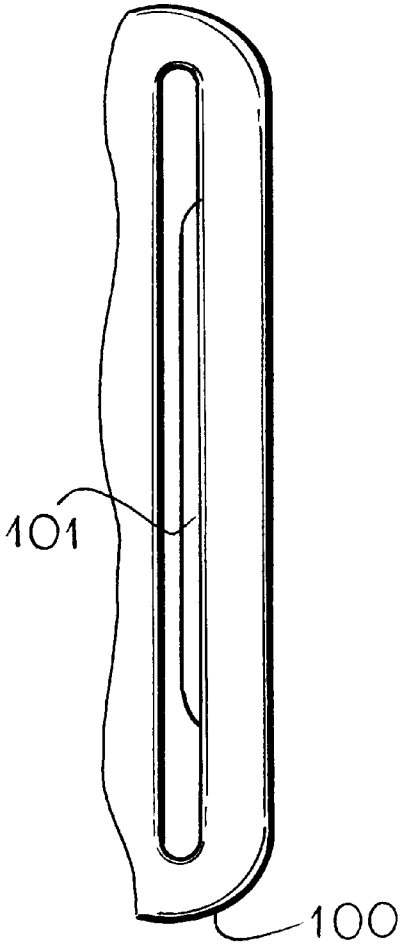
FIG. 25 is an elevational view showing another bulge shape.
Figure 24:
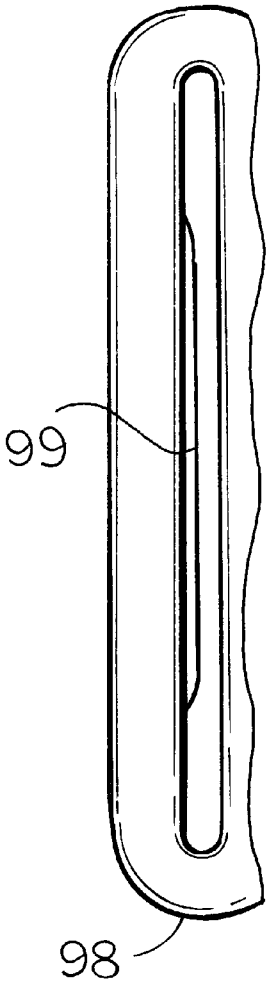
FIG. 24 is an elevational view of the loop of a closure similar to that of FIG. 22 but with a modified shape of the bulge.

As can be seen from FIG. 24, the bulge 99 may be curved uniformly from one end to the other by contrast with the bulges 95 and 97 which are of substantially uniform thickness except for the ends of the bulge. The bulge 101 for the loop 100 in FIG. 25 has ends which are squared off by comparison with the sloping ends of the bulges 95 and 97. The bulges can be provided over only part of the thickness of the eye or loop and can be shaped asymmetrically s shown for the bulge 95 (FIG. 23) or in the plane of symmetry of the member as shown for the bulge 97 in FIG. 23.

Figure 26:
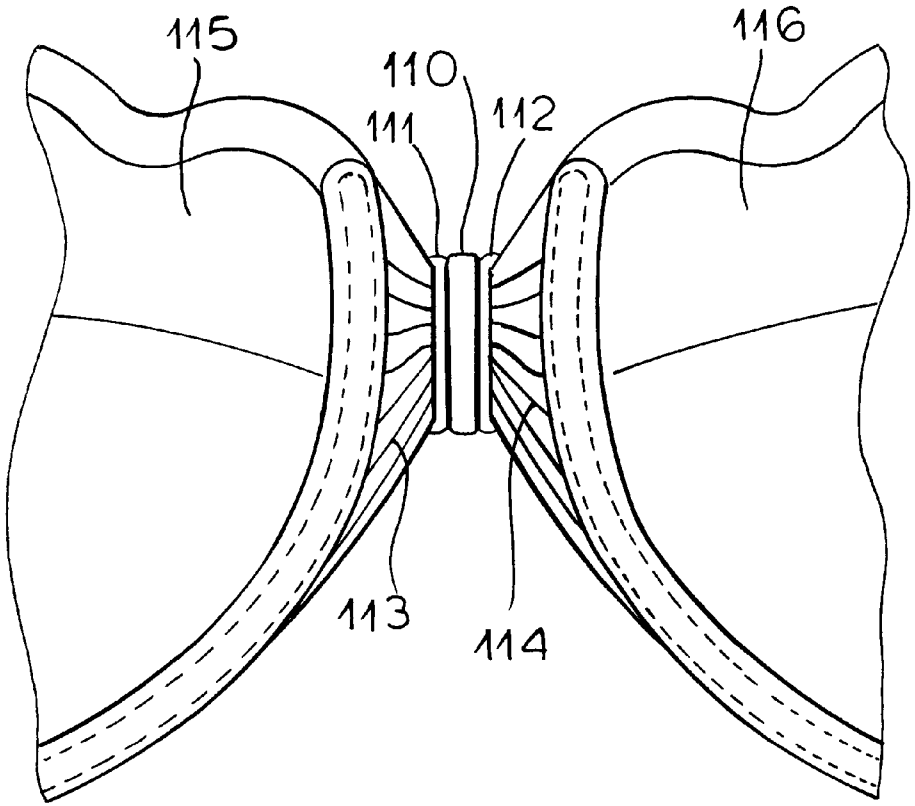
FIG. 26 is a view similar to FIG. 1 showing another approach to the attachment of the front closure to the brassiere.

FIG. 26 shows a system for attaching the fastener 110 to the brassiere cups 115 and 116 via the eyes or loops 111 and 112 by fabric strips 113 and 114 which are gathered in passing through the respective eye or loop.

I claim:

1. A closure for a garment comprising:

a one-piece molded male closure member having an elongated first frame formed from a pair of parallel limbs connected by bights at opposite ends and surrounding an elongated slot whereby a first garment part is adapted to be looped around one of said limbs through said slot, a bar spaced from and parallel to the other of said limbs, and a pair of webs spaced inwardly from opposite ends of said bar and from one another connecting said bar with said other of said limbs, said first frame, said bar and said webs lying in a first plane;

a one-piece molded female closure member having an elongated second frame formed from a pair of parallel limbs connected by bights at opposite ends and surrounding an elongated slot whereby a second garment part is adapted to be looped around one of said limbs of said second frame and through said slot thereof, a trough formed on the other of said limbs of said second frame, lying in a second plane therewith and adapted to receive said bar in a position of said male member such that said first plane is substantially transverse to said second plane, said troughs having cutouts accommodating said webs upon; and detent means on at least one of said closure members between said webs and said cutouts for resiliently retaining said closure members in their coplanar positions.

2. The closure defined in claim 1 wherein said bar is round.

3. The closure defined in claim 1 wherein said bar is polygonal.

4. The closure defined in claim 1 wherein said trough is open laterally over the entire length of said bar.

5. The closure defined in claim 1 wherein said trough is open laterally over a major portion of the length of said bar and opens longitudinally into a sleeve of a length corresponding to a remaining portion of the length of said bar whereby said bar must be shifted longitudinally in said trough into said sleeve to permit said rotation of said male closure member relative to said female closure member about said axis of said bar to render said closure members coplanar.

6. The closure defined in claim 5 wherein said sleeve is formed with a hole opening longitudinally away from said trough.

7. The closure defined in claim 1 wherein said female member is formed with a flange overlying said webs in said coplanar positions.

8. The closure defined in claim 1 wherein said detent means is a lock nose engaging said bar.

9. A front-closing brassiere, comprising a brassiere garment having two fabric cup portions and a front closure detachably connecting said cup portions, said front closure including:

a one-piece molded male closure member having an elongated first frame formed from a pair of parallel limbs connected by bights at opposite ends and surrounding an elongated slot whereby a one of said cup portions is looped around one of said limbs through said slot, a bar spaced from and parallel to the other of said limbs, and a pair of webs spaced inwardly from opposite ends of said bar and from one another connecting said bar with said other of said limbs, said first frame, said bar and said webs lying in a first plane;

a one-piece molded female closure member having an elongated second frame formed from a pair of parallel limbs connected by bights at opposite ends and surrounding an elongated slot whereby the other of said cup portions is looped around one of said limbs of said second frame and through said slot thereof, a trough formed on the other of said limbs of said second frame, lying in a second plane therewith and adapted to receive said bar in a position of said male member such that said first plane is substantially transverse to said second plane, said troughs having cutouts accommodating said webs upon; and detent means on at least one of said closure members between said webs and said cutouts for resiliently retaining said closure members in their coplanar positions.

10. The brassiere defined in claim 9 wherein said bar is round.

11. The brassiere defined in claim 9 wherein said bar is polygonal.

12. The brassiere defined in claim 9 wherein said trough is open laterally over the entire length of said bar.

13. The brassiere defined in claim 9 wherein said trough is open laterally over a major portion of the length of said bar and opens longitudinally into a sleeve of a length corresponding to a remaining portion of the length of said bar whereby said bar must be shifted longitudinally in said trough into said sleeve to permit said rotation of said male closure member relative to said female closure member about said axis of said bar to render said closure members coplanar.

14. The brassier defined in claim 13 wherein said sleeve is formed with a hole opening longitudinally away from said trough.

15. The brassiere defined in claim 9 wherein said female member is formed with a flange overlying said webs in said coplanar positions.

16. The brassiere defined in claim 9 wherein said detent means is a lock nose engaging said bar.

17. The front closure defined in claim 9 herein the cup portions passing through said slots are gathered.

18. The front closure defined in claim 9 wherein an outer one of the limits defining each of said slots is formed with a bulge projecting into a respective slot for holding fabric of a respective one of said cup portions close to the other limit of the respective slot even under the development of tension between said cup portions.

19. A front closure for a brassiere comprising:

a female member having an aesthetic front face and a rear face provided with a channel overhung by opposite flanks;

a male member having a frame portion connectable to a fabric portion of one cup of a brassiere and a bar removably receivable in said channel, said bar having a width accommodated between said flanks in a position of said frame portion transverse to said female member and lodged beneath said flanks upon rotation of said frame portion about an axis of said bar into substantial coplanarity with said female member; and means for affixing said female member to a fabric portion of another cup of said brassiere.

20. The front closure defined in claim 19 wherein said means for affixing is another frame portion secured to said female member.

21. The front closure defined in claim 20 wherein each of said frame portions has a respective bar received in a respective one of said channels, one of said bars being removable from the respective channel and the other of said bars being permanently secured in the respective channel.

22. The front closure defined in claim 19 wherein said frame portion has a limb parallel to said bar and resiliently secured in another channel of said female member upon rotation of said frame portion into substantial coplanarity with said female member.

* * * * *